US011737558B1

(12) United States Patent
Geah et al.

(10) Patent No.: US 11,737,558 B1
(45) Date of Patent: Aug. 29, 2023

(54) SHOE STORAGE DEVICE AND SYSTEM

(71) Applicants: Josie Geah, Hillside, NJ (US); Rosaline Geah, Hillside, NJ (US)

(72) Inventors: Josie Geah, Hillside, NJ (US); Rosaline Geah, Hillside, NJ (US)

( * ) Notice: Subject to any disclaimer, the term of this patent is extended or adjusted under 35 U.S.C. 154(b) by 0 days.

(21) Appl. No.: 17/929,689

(22) Filed: Sep. 3, 2022

(51) Int. Cl.

| | |
|---|---|
| ***A47B 61/04*** | (2006.01) |
| ***B65D 25/04*** | (2006.01) |
| ***B65D 21/02*** | (2006.01) |
| ***B65D 85/18*** | (2006.01) |
| ***B65D 25/28*** | (2006.01) |
| ***B65D 25/24*** | (2006.01) |

(52) U.S. Cl.
CPC ..... *A47B 61/04* (2013.01); *B65D 21/0201* (2013.01); *B65D 25/04* (2013.01); *B65D 25/24* (2013.01); *B65D 25/2808* (2013.01); *B65D 85/187* (2013.01)

(58) Field of Classification Search
CPC ..... A47B 61/04; A47B 88/941; A47B 88/413; A47B 2210/16; B65D 21/0201; B65D 25/04; B65D 25/24; B65D 25/2808; B65D 85/187; A47C 17/86
See application file for complete search history.

(56) References Cited

U.S. PATENT DOCUMENTS 4,343,054 A * 8/1982 Kane ..... A47C 17/16 5/18.1
4,597,122 A * 7/1986 Handler ..... A47B 88/41 5/503.1
5,050,746 A 9/1991 Frankel
5,070,556 A * 12/1991 Gloger ..... A47C 17/86 312/334.25
5,104,208 A 4/1992 Gesing
RE34,570 E 3/1994 Fromkin
(Continued)

OTHER PUBLICATIONS

Ikea, "Under bed storage", https://www.ikea.com/us/en/cat/under-bed-storage-19059/, accessed Aug. 10, 2022, (8 pages).
(Continued)

*Primary Examiner* — Hiwot E Tefera
(74) *Attorney, Agent, or Firm* — Ware, Fressola, Maguire & Barber LLP

(57) ABSTRACT

A storage system is provided including a plurality of adjacent storage apparatuses, each comprising: a plurality of adjoining storage compartments, including front and rear storage compartments, and one or more intermediate storage compartments arranged in between. Each storage compartment may include a removable insert forming an angled bottom compartment surface. Each storage apparatus comprises opposing hook-like elements spanning each longitudinal side of the storage apparatus. The hook-like element on one side of a storage apparatus engages the opposing hook-like element of an adjacent of storage apparatus to connect the two storage apparatuses to each other, and such connections are provided iteratively across the plurality of storage apparatuses. The hook-like element of one storage apparatus is configured to slide through the opposing hook-like element of the adjacent storage apparatus to enable sliding one storage apparatus relative to the adjacent storage apparatus.

20 Claims, 8 Drawing Sheets

(56) References Cited

U.S. PATENT DOCUMENTS

| | | | | |
|---|---|---|---|---|
| 5,423,435 | A | 6/1995 | Pollard et al. | |
| 5,984,113 | A | 11/1999 | Roberson | |
| D481,560 | S | 11/2003 | Vidmar et al. | |
| 6,915,913 | B2 | 7/2005 | Cardinell | |
| 7,249,674 | B2 | 7/2007 | Mu et al. | |
| 7,281,634 | B2 | 10/2007 | Marchetta et al. | |
| 7,296,697 | B2 | 11/2007 | Costa et al. | |
| 7,314,144 | B2 | 1/2008 | Stitchick et al. | |
| 7,699,181 | B2 | 4/2010 | Torro | |
| 7,945,977 | B1 | 5/2011 | Tucker | |
| 8,016,127 | B1 | 9/2011 | Crump | |
| 8,375,483 | B2 * | 2/2013 | Ray | A47C 7/62 5/28 |
| 8,656,533 | B2 * | 2/2014 | Grossman | A47B 95/002 5/493 |
| 8,943,713 | B1 | 2/2015 | Eidson | |
| 8,967,742 | B1 | 3/2015 | Huewitt, Jr. | |
| 10,231,553 | B1 * | 3/2019 | Gregory | A47C 19/025 |
| 2004/0040960 | A1 * | 3/2004 | Gledhill | B65D 21/0204 220/4.03 |
| 2009/0025141 | A1 * | 1/2009 | Ray | A47C 17/136 5/20 |
| 2011/0192840 | A1 * | 8/2011 | Vazquez | B65D 85/187 211/85.3 |
| 2014/0245933 | A1 * | 9/2014 | Leslie | A47C 17/86 108/50.11 |

OTHER PUBLICATIONS

Amazon, "Under bed drawers on wheels", https://www.amazon.com/under-bed-drawers-wheels/s?k=under+bed+drawers+on+wheels, accessed Aug. 10, 2022 (14 pages).

Target, "Under bed storage drawers", https://www.target.com/s/under+bed+storage+drawers, accessed Aug. 10, 2022 (6 pages).

Bed, Bath & Beyond, "Underbed storage", https://www.bedbathandbeyond.com/store/category/storage-cleaning/storage-organization/underbed-storage/14308, accessed Aug. 10, 2022 (10 pages).

The Container Store, "Under bed drawer", https://www.containerstore.com/s/closet/under-the-bed-storage/12?productId=10000201, accessed Aug. 10, 2022 (10 pages).

The Container Store, "Our long under bed box with wheels", https://www.containerstore.com/s/storage/plastic-bins-baskets/our-long-under-bed-box-with-wheels/12d?productId=10009994, accessed Aug. 10, 2022 (12 pages).

Wayfair, "storage drawers for under bed", https://www.wayfair.com/keyword.php?keyword=storage+drawers+for+under+bed, accessed Aug. 10, 2022 (15 pages).

Walmart, "white underbed storage drawers", https://www.walmart.com/c/kp/white-underbed-storage-drawers, accessed Aug. 10, 2022 (3 pages).

* cited by examiner

SHOE STORAGE DEVICE AND SYSTEM

BACKGROUND OF THE DISCLOSURE

In dwellings or living spaces with limited space, it can be difficult to find room for storage of items, particularly clothing and shoes. One option for solving this problem is storing items underneath a bed, where the space is otherwise unused. There are currently many storage devices available that can be used to store items under a bed, however these suffer many practical limitations. In many instances, such storage devices are large plastic or fabric storage containers that require their entire removal from underneath the bed to open them, and then be searched through for the desired item. Other storage devices for under a bed are wide drawers, which may be uncovered and provide a single wide compartment without organizational optionality.

SUMMARY OF THE DISCLOSURE

In accordance with the present application, a storage device and system for use in storage of footwear or other items is provided that is designed to slide underneath a bed frame. The storage system includes wheels with a rubber like tread to accommodate smooth rolling in and out, working equally well on carpeted or hard floor surfaces. The storage system can be made of a rigid plastic material that is semi-transparent to visually see the contents of the storage.

The storage system comprises a series of compartments ranging in different size arrangements to fit under different sizes of beds. For example, a three-compartment storage apparatus will fit under a twin sized bed while a six-compartment storage apparatus will fit under a king size. Each compartment may have its own set of wheels and a removable plastic insert, which is slightly angled, and with a gripping top surface. If the insert is removed, this can also allow the compartment to be used to store other items besides footwear. The front compartment may have an extended upper lip to prevent the compartment from being pushed too far underneath the bed, with the side of the lip that faces the bed having a rubber or silicone bumper to prevent any damage to the bed or frame surface. The front may also have a handle built into the mold of the storage system with a placard just underneath it for writing in the contents of the storage system.

Each longitudinal side of the storage device has C-shaped hooks. The hook on one side faces up while the hook on the other side faces down. When two or more storage devices are placed side by side, the hooks function as an interlocking mechanism to keep the units in place and from individually sliding around. The storage system may also comprise a cloth or tarp-like removable dust cover that has pegs in all four corners that slip into holes on the four corners of the storage system, keeping the cover tight and the contents of the storage device free from dust and debris.

In accordance with a first aspect of the present application, a storage apparatus is provided. The apparatus comprises a plurality of adjoining storage compartments, including: a front storage compartment arranged at a front end of the apparatus; a rear storage compartment arranged at a rear end of the apparatus; and one or more intermediate storage compartments arranged in between the front storage compartment and the rear storage compartment; wherein each of the front storage compartment, the rear storage compartment, and the one or more intermediate storage compartments may include a removable insert forming an angled bottom surface configured to store one or more items at an angle. The apparatus also includes a plurality of wheels arranged on a base of one or more of the plurality of adjoining storage compartments. The apparatus also includes a removable cover configured to cover an open surface on a top of the plurality of adjoining storage compartments. The apparatus also includes a first hook-like element spanning the plurality of adjoining storage compartments along a first longitudinal side of the apparatus between the front end and the rear end, the first hook-like element having a first orientation. The apparatus also includes a second hook-like element spanning the plurality of adjoining storage compartments along a second longitudinal side of the apparatus between the front end and the rear end, the second hook-like element having a second orientation that is opposite the first orientation. The apparatus also includes an outer face on the front storage compartment that may include a handle.

Implementations of the apparatus of the first aspect of the present application may include one or more of the following features, separately or in combination. The base of each of the plurality of adjoining storage compartments compartment may include at least two opposing wheels.

The one or more intermediate storage compartments may consist of one intermediate storage compartment with the plurality of adjoining storage compartments consisting of three adjoining storage compartments; or the one or more intermediate storage compartments consist of two intermediate storage compartments with the plurality of adjoining storage compartments consisting of four adjoining storage compartments; or the one or more intermediate storage compartments may consist of three intermediate storage compartments with the plurality of adjoining storage compartments consisting of five adjoining storage compartments; or the one or more intermediate storage compartments may consist of four intermediate storage compartments with the plurality of adjoining storage compartments consisting of include of six adjoining storage compartments.

The removable insert may include: a frictional surface configured to engage items placed thereon; and a handle configured to allow removal of the removable insert. The outer face may include: an upper lip extending above a height of the one or more intermediate storage compartments and the rear storage compartment and may include a bumper pad on a reverse side of the outer face; and a placard. The first hook-like element and the second hook-like element can be C-shaped hooks. The front storage compartment may include a first pair of holes on opposite longitudinal sides; the rear storage compartment may include a second pair of holes on opposite longitudinal sides; the removable cover may include four pegs configured to engage each hole of the first pair of holes and the second pair of holes to secure the removable cover to the plurality of adjoining storage compartments; and the removable cover is formed of a cloth or fabric material. The plurality of adjoining storage compartments may be made of a semi-transparent or transparent plastic material to enable a user to view contents of the plurality of adjoining storage compartments. The plurality of adjoining storage compartments may have a length between eleven and fourteen inches. The apparatus may further comprise a plurality of divider walls, wherein each of the divider walls separates two adjoining storage compartments and can move longitudinally through the apparatus to adjust a length of a storage compartment.

In accordance with a second aspect of the present application, a storage system is provided. The storage system includes a plurality of adjacent storage apparatuses, each storage apparatus comprising: a plurality of adjoining storage compartments, including a front storage compartment arranged at a front end of the storage apparatus; a rear storage compartment arranged at a rear end of the apparatus; and one or more intermediate storage compartments arranged in between the front storage compartment and the rear storage compartment; wherein each of the front storage compartment, the rear storage compartment, and the one or more intermediate storage compartments may include a removable insert forming an angled bottom surface configured to store one or more items at an angle. Each storage apparatus further comprises: a plurality of wheels arranged on a base of one or more of the plurality of adjoining storage compartments; a removable cover configured to cover an open surface on a top of the plurality of adjoining storage compartments; a first hook-like element spanning the plurality of adjoining storage compartments along a first longitudinal side of the storage apparatus between the front end and the second end, the first hook-like element having a first orientation; a second hook-like element spanning the plurality of adjoining storage compartments along a second longitudinal side of the apparatus between the front end and the rear end, the second hook-like element having a second orientation that is opposite the first orientation; and an outer face on the front storage compartment may include a handle. In the storage system, the first hook-like element of one of the plurality of adjacent storage apparatuses is configured to engage the second hook-like element of an adjacent of the plurality of storage apparatuses to provide a connection between two of the plurality of storage apparatuses to each other, said connection being provided iteratively across the plurality of storage apparatuses connecting adjacent storage apparatuses. Further in the storage system, for each adjacent pair of storage apparatuses, the first hook-like element of one storage apparatus of the pair is configured to slide through the second hook-like element of the adjacent storage apparatus in the pair to enable sliding on the plurality of wheels of one storage apparatus in the pair relative to the adjacent storage apparatus.

Implementations of the storage system of the second aspect of the present application may include one or more of the following features, separately or in combination. The storage system may comprise four adjacent storage apparatuses. The plurality of storage apparatuses may include at least one storage apparatus having a length and a number of adjoining storage compartments that differs from at least one other storage apparatus in the storage system. The first hook-like element and the second hook-like element can be C-shaped hooks. For each storage apparatus in the storage system, the front storage compartment comprises a first pair of holes on opposite longitudinal sides; the rear storage compartment comprises a second pair of holes on opposite longitudinal sides; the removable cover comprises four pegs configured to engage each hole of the first pair of holes and the second pair of holes to secure the removable cover to the plurality of adjoining storage compartments; and the removable cover is formed of a cloth or fabric material. Each of the plurality of adjoining storage compartments of the plurality of storage apparatuses may comprise a length between eleven and fourteen inches. Each of the plurality of storage apparatuses may further comprise a plurality of divider walls, wherein each of the divider walls separates two adjoining storage compartments and can move longitudinally through the apparatus to adjust a length of a storage compartment.

DETAILED DESCRIPTION OF THE DRAWINGS

A storage apparatus 10 and storage system 25 according to the present application will now be described with reference made to FIGS. 1-7B.

A storage apparatus 10 is used in the storage of footwear or other items and is designed to fit and slide underneath the frame of a bed 30. The storage apparatus 10 comprises wheels 14 on its base to accommodate smooth rolling in and out of the storage apparatus 10 from underneath the bed 30. The storage apparatus 10 comprises a series of storage compartments 11*a*, 11*b*, 11*c*, each of which is configured to store items such as footwear. One or more pairs of wheels 14 may be provided on the base of each storage compartment 11*a*, 11*b*, 11*c*. As shown for example in FIGS. 3 and 4, each storage compartment 11*a*, 11*b*, 11*c* may comprise two pairs of wheels 14. Alternatively, the wheels 14 may be placed on fewer than all the storage compartments 11*a*, 11*b*, 11*c*, such as only on the front and rear storage compartments 11*a*, 11*b*, as shown for example in FIG. 5B.

Figure 3:
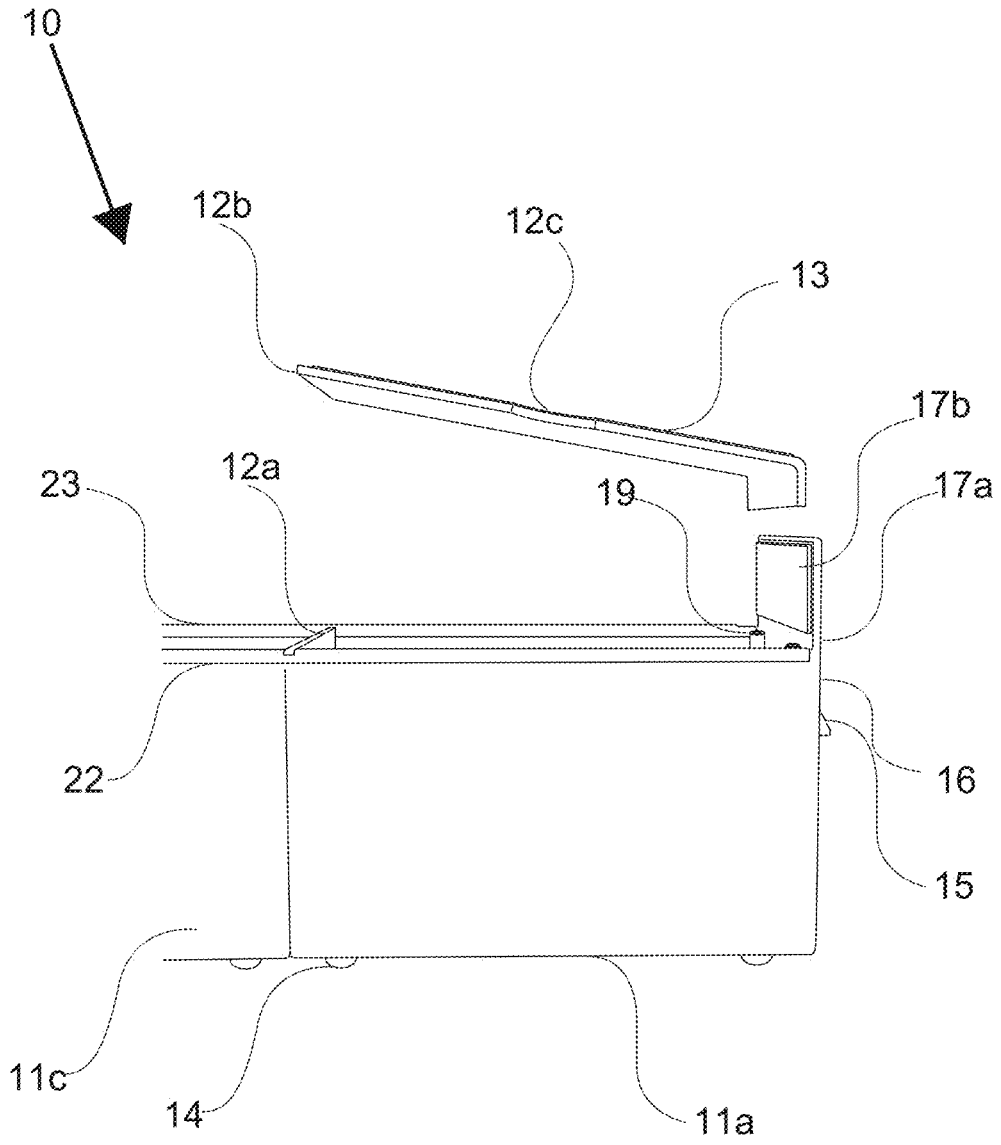
FIG. 3 shows a side elevation view of the storage apparatus.
Figure 4:
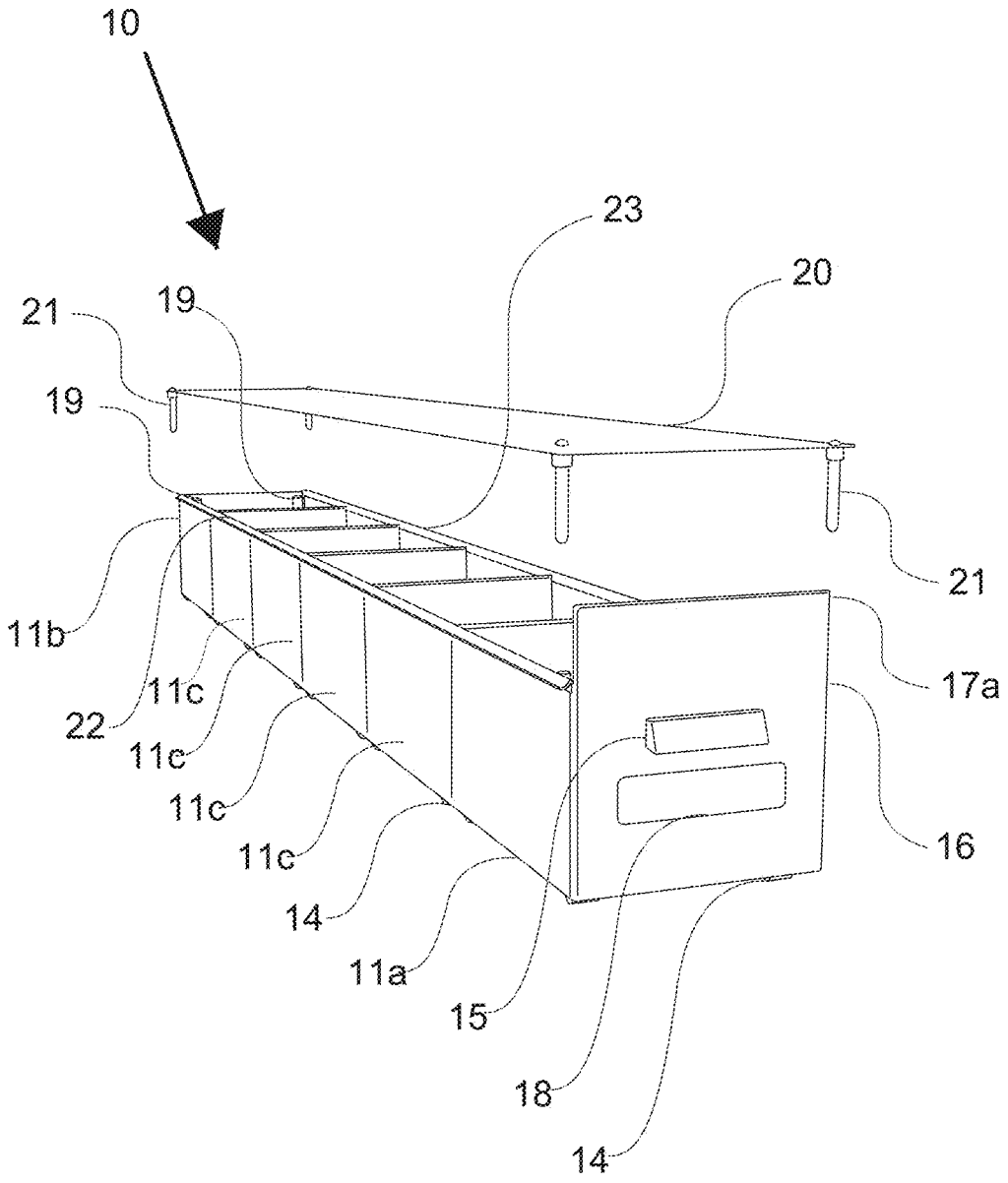
FIG. 4 shows a perspective view of the storage apparatus.
Figure 5A:
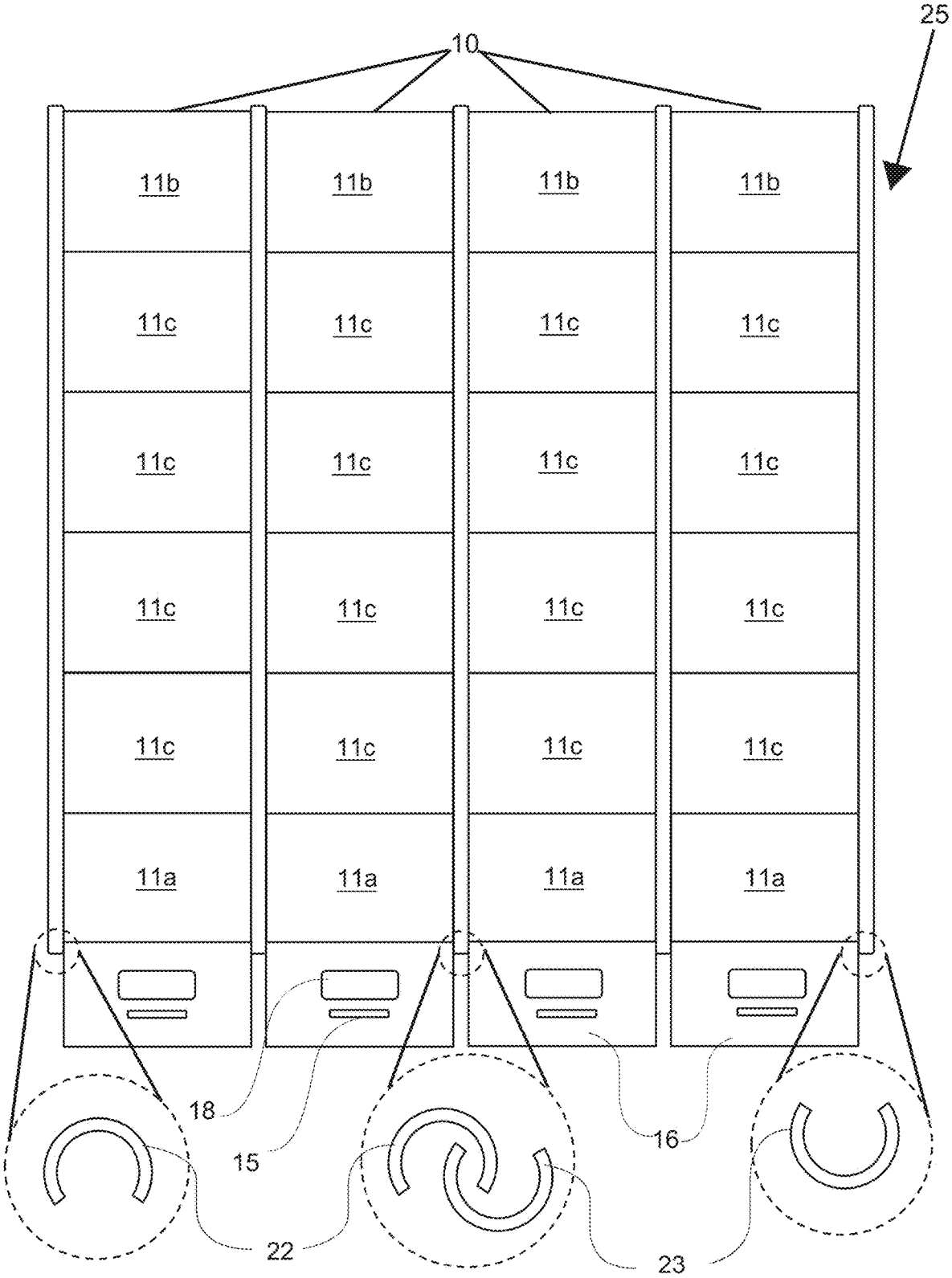
FIG. 5A shows a top view a top view of a storage system to the present application.
Figure 5B:
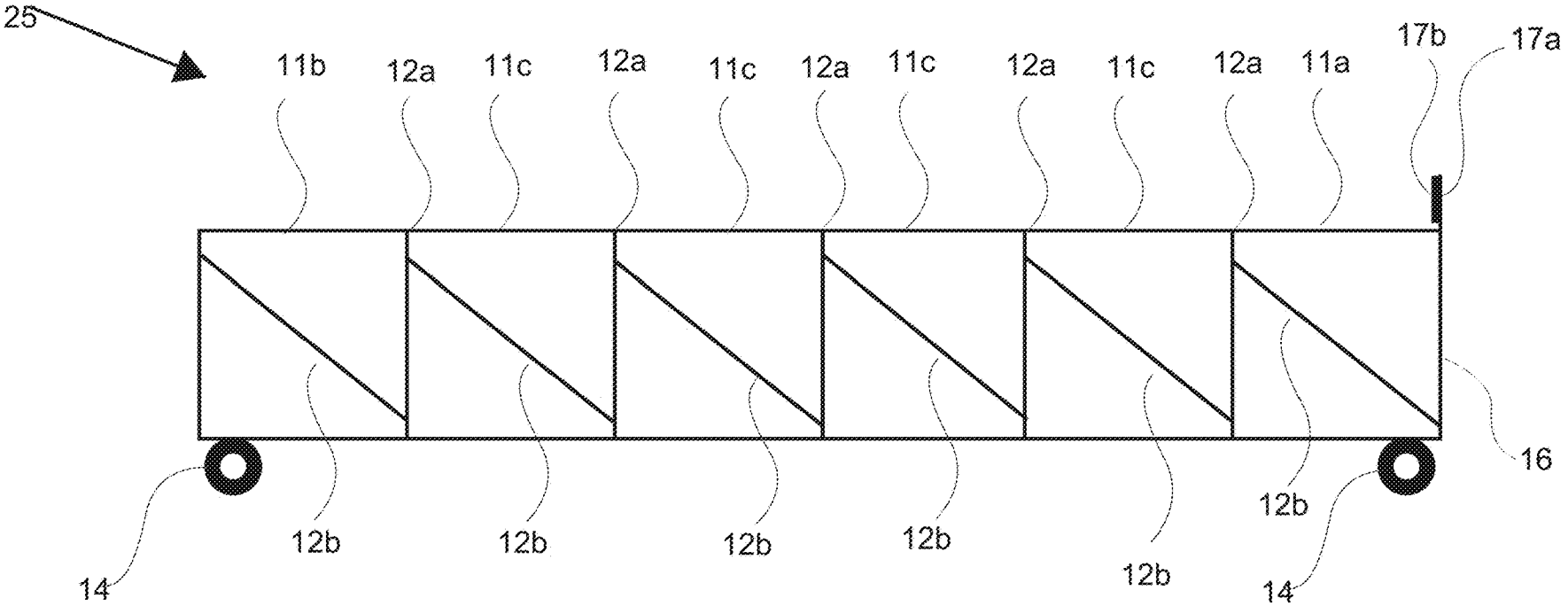
FIG. 5B shows a side view of the storage system of FIG. 5A.

Each of the storage compartments 11*a*, 11*b*, 11*c* may also comprise a removable insert 12*b*. The insert 12*b* can be slightly angled when placed inside the storage compartment 11*a*, 11*b*, 11*c*, as shown in FIG. 5B for example, and have a frictional surface 13. The angled surface of the insert 12*b* allows for the easier viewing of the footwear (or other items) within the storage compartment 11*a*, 11*b*, 11*c*. When the insert 12*b* is removed, the storage compartments 11*a*, 11*b*, 11*c* can be used to store other items besides footwear. The insert 12*b* may comprise a segment that is parallel to the wall 12*a*, as shown in FIG. 3, which allows the insert 12*b* to sit securely between adjacent walls 12*a* and the floor of a compartment. The interior of the storage compartments 11*a*, 11*b*, 11*c* may be provided with one or more stops (not shown) on the compartment floor and/or on the wall(s) 12*a*, on which an undersurface of the insert 12*b* may rest, and which prevent the insert 12*b* from collapsing into the storage compartment 11*a*, 11*b*, 11*c*. The inserts 12*b* may also be provided with one or more handles 12*c*, which allow the insert 12*b* to be removed from the storage compartment 11*a*, 11*b*, 11*c*. As shown for example in FIG. 3, the handle 12*c* may take the form of a cutout on one side of the insert 12*b*, which creates an opening that allows the user's hand to be inserted to lift out the insert 12*b*, or can be a thumb impression or a groove, or a handle that can be raised or lowered from the surface of the insert 12*b* with a hinge mechanism. The handle 12*c* can be provided on the outer or the inner surface of the insert 12*b*. The insert 12*b* can be made of plastic or other material, similar to the storage apparatus 10. The frictional surface 13 of the insert 12*b* may be provided with bumps, ridges, grooves, or the like, and/or may be made of a different material providing greater friction, so that the footwear or other items placed on the insert 12*b* are engaged by the frictional surface 13 and do not slide or move within the storage compartment 11*a*, 11*b*, 11*c*. Variations of the insert 12*b* can be provided for particular applications, such as an insert 12*b* including holes to accommodate heels from high heel shoes.

Each storage apparatus 10 is configured with a front storage compartment 11*a*, a rear storage compartment 11*b*, and may include intermediate storage compartments 11*c* arranged in between the front storage compartment 11*a* and rear compartment 11*b*. As shown for example in FIG. 6, the number of intermediate storage compartments 11*c* may vary between storage apparatuses 10, wherein a storage apparatus 10 may be provided with no intermediate storage compartments 11*c* (only having front and rear storage compartments 11*a*, 11*b*) or may be provided with four or more intermediate storage compartments 11*c*. The length (distance from front to back) of a storage compartment 11*a*, 11*b*, 11*c* may be approximately eleven to fourteen inches, and may further be approximately 12.5 inches, but other embodiments may have different dimensions. The number of storage compartments 11*a*, 11*b*, 11*c* may vary to provide a storage apparatus 10 of different lengths to fit under beds 30 of different sizes. For example, a storage apparatus 10 having three storage compartments 11*a*, 11*b*, 11*c* is dimensioned to fit under the width of a standard twin sized bed (38 inches wide by 75 inches long), and a storage apparatus 10 having six storage compartments 11*a*, 11*b*, 11*c* is dimensioned fit under the width of a standard king size bed (76 inches wide by 80 inches long), or under the length of a twin size bed, king size bed, or queen size bed (60 inches wide by 80 inches long). The height of the storage apparatus 10 (including wheels and excluding the lip 17*a*) is such that it enables the storage apparatus 10 to fit under a bed 30, such as between four and twelve inches.

Figure 1:
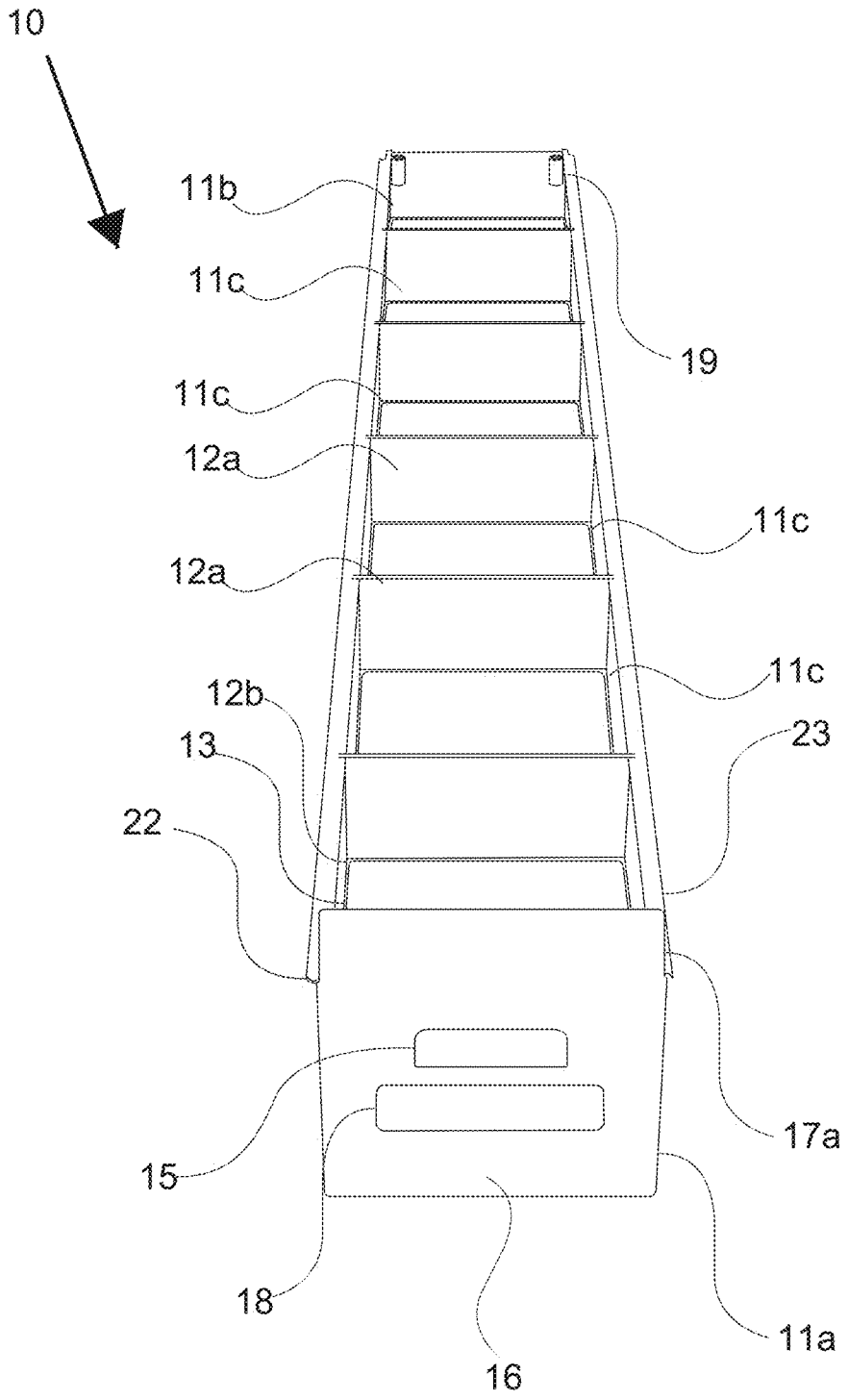
FIG. 1 shows a top elevation view perspective of a storage apparatus according to the present application.
Figure 2:
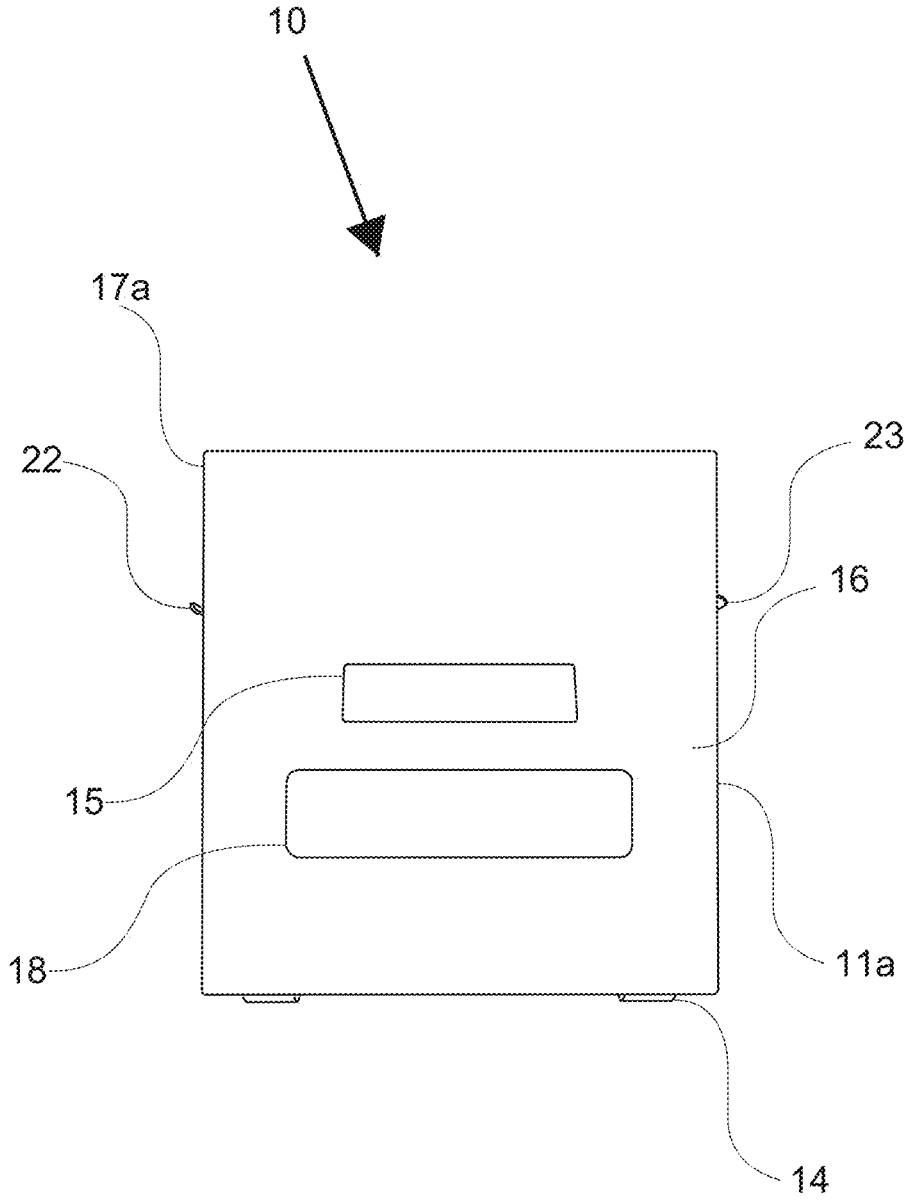
FIG. 2 shows a front elevation view of the storage apparatus.

The dimensions of each storage compartment 11*a*, 11*b*, 11*c* may also vary or may be adjustable. The storage compartments 11*a*, 11*b*, 11*c* comprise a dividing wall 12*a* to provide separation between adjacent compartments. In certain embodiments, the dividing wall 12*a* is preformed as an integral part of the storage compartment 11*a*, 11*b*, 11*c* and is fixed in place. In other embodiments, the dividing wall 12*a* is configured to be removable and/or moveable within the storage apparatus 10. For example, as shown in FIGS. 1 and 3, the dividing walls 12*a* may comprise hooks, pins, or other elements along the top that allow the wall 12*a* to slide forward or backward through the storage apparatus 10 to change the size of a storage compartment 11*a*, 11*b*, 11*c*. Additional mechanisms may be provided on the dividing wall 12*a* configured to engage the storage apparatus 10 and lock the dividing wall 12*a* in a position once adjusted.

The front storage compartment 11*a* is provided with an outer face 16. The outer face 16 has an extended upper lip 17*a* arranged at the top of the outer face 16, which extends above the other storage compartments 11*b*, 11*c* of the storage apparatus 10. The upper lip 17*a* is configured to prevent the storage apparatus 10 from being pushed too far underneath the bed 30, as the upper lip 17*a* would abut the bed 30 when the storage apparatus 10 is pushed under a bed, as shown for example in FIGS. 7A and 7B. The reverse side of the upper lip 17*a* (i.e., the side that faces the bed 30) can be provided with a bumper pad 17*b* made of rubber, silicone, or other soft or padded material, to prevent any damage to the bed 30 when the upper lip 17*a* contacts the bed 30. The outer face 16 of the storage apparatus 10 also comprises a handle 15, which may be built into the mold of the storage apparatus 10 or affixed to the outer face 16. The outer face 16 also comprises a placard 18, which may be below or above the handle 15, for writing in the contents of the storage apparatus 10 or for receiving an external writing identifying the contents of the storage apparatus 10. In other variations of the storage apparatus 10, the upper lip 17*a* may be omitted, and the rear storage compartment 11*b* may comprise a similar outer face 16 with a handle 15 and placard 18, which would allow the storage apparatus 10 to be pulled out from either side of the bed 30.

The storage apparatus 10 may further comprise a cover 20 that is configured to cover the storage compartments 11*a*, 11*b*, 11*c* to prevent the accumulation of dust and debris on the contents of the storage apparatus 10. The cover 20 may be formed of cloth or tarp-like material and is removable from the storage apparatus 10. The cover 20 may also be made of an elastic material. In a preferred embodiment shown in FIG. 4 for example, the front storage compartment 11*a* and the rear compartment 11*b* are provided with tubular elements that form holes 19 at the four corners of the storage apparatus 10 and which are configured to receive pegs 21 that are arranged on the four corners of the cover 20, so as to keep the cover 20 tightly arranged on the storage apparatus 10 and the contents of the storage compartments 11*a*, 11*b*, 11*c* free from dust and debris. The holes 19 for receiving the pegs 21 of the cover 20 may be provided on the outer surface of the storage compartments 11*a*, 11*b* or on the inner surface of the storage compartments 11*a*, 11*b*.

Additionally, embodiments of the storage apparatus 10 can be provided with additional holes 19 on one or more intermediate compartments 11*c*, and the cover 20 may be provided with additional pegs 21 to provide a tighter fit along the entire length of the apparatus 10. Further, the placement of the holes 19 and pegs 21 can be reversed, wherein the cover 20 comprises holes 19 for receiving pegs 21 projecting from the storage compartments 11*a*, 11*b*, 11*c*. In other embodiments of the storage apparatus 10, alternative means for securing the cover 20 to the storage compartments 11*a*, 11*b*, 11*c* may be provided. For example, the cover 20 may be retractable, or may be formed into a roll or spiral at the rear of the storage apparatus 10 that may be pulled out towards and engage with the front storage compartment 11*a*, similar to a retractable window treatment.

Each longitudinal side of the storage apparatus 10 comprises hooks 22, 23 running the length of the storage apparatus 10. The hooks 22, 23, may be C-shaped hooks, and are provided so that two storage apparatuses 10 may be placed next to each other to form a storage system 25, and engage each other in a manner that allows for one storage apparatus 10 to be moved relative to the other storage apparatus 10. Each longitudinal side of the storage apparatus 10 is provided with a hook 22, 23, and the hook 22 on one longitudinal side is provided in the opposite orientation of the hook 23 on the opposite side.

In the embodiment shown in FIG. 1 for example, the left longitudinal side of the storage apparatus 10 is provided with C-hooks 22 that are open at the top, and the right longitudinal side of the storage apparatus 10 is provided with C-hooks 23 that are open at the bottom. In FIG. 5, the storage apparatuses 10 have the reverse arrangement, the left longitudinal side of each storage apparatus 10 is provided with C-hooks 22 that are open at the bottom and the right longitudinal side of the storage apparatus 10 is provided with C-hooks 23 that are open at the top. Either arrangement can be utilized, provided that in a storage system 25 comprising two or more storage apparatuses 10, each storage apparatus 10 comprises the same orientation of hooks 22, 23. Because the left and right longitudinal sides of each storage apparatus 10 have opposite arrangements of the hooks 22, 23, the hooks 23 on the right side of one storage apparatus 10 are configured to engage with the hooks 22 on the left longitudinal side of an adjacent storage apparatus 10, and vice versa. When two or more storage apparatus 10 are placed side to side to form a storage system 25, the hooks 22, 23 serve as an interlocking mechanism to keep the storage apparatuses 10 in place and from individually sliding around, as shown for example in FIG. 5A. One storage apparatus 10 may be pulled out separately from the others in the storage system 25, as shown for example in FIG. 7B, as the hooks 22, 23 on the storage apparatus 10 slide through the hooks 22, 23 on the adjacent storage apparatuses 10. It is noted that the terms "left", "right", "top", and "bottom" are used herein only for clarity of explanation and are relative to the arrangements of the storage apparatus 10 and storage system 25 shown in FIGS. 1 and 5A and are not intended to limit the scope of the invention.

The storage apparatus 10 can be made of any number of materials, including a rigid plastic material. The material of the storage apparatus 10 may also be transparent or semi-transparent to allow a user to visually see the contents of the storage apparatus 10, as shown for example in FIG. 5B.

FIGS. 1-4 show various views of a single storage apparatus 10. In this embodiment of the storage apparatus 10, the apparatus comprises six storage compartments 11*a*, 11*b*, 11*c*, including four intermediate storage compartments 11*c*. Each storage compartment 11*a*, 11*b*, 11*c* includes a removable insert 12*b* with the frictional surface 13. A handle 15 is provided on the outer face 16 of the front storage compartment 11*a* to pull the storage compartments 11*a*, 11*b*, 11*c*. A placard 18 is also provided on the outer face 16 of the front storage compartment 11*a* where the description of the items can be written. The outer face 16 of the front storage compartment 11*a* comprises the upper lip 17*a* with a bumper pad 17*b* arranged on the opposite surface. The front storage compartment 11*a* and rear storage compartment 11*b* of the storage apparatus 10 comprise the holes 19 for receiving the pegs 21 of the cover 20. Along the upper edges of the longitudinal sides of the storage apparatus 10, hooks 22 and 23 are provided along the length of the storage apparatus 10.

Figure 6:
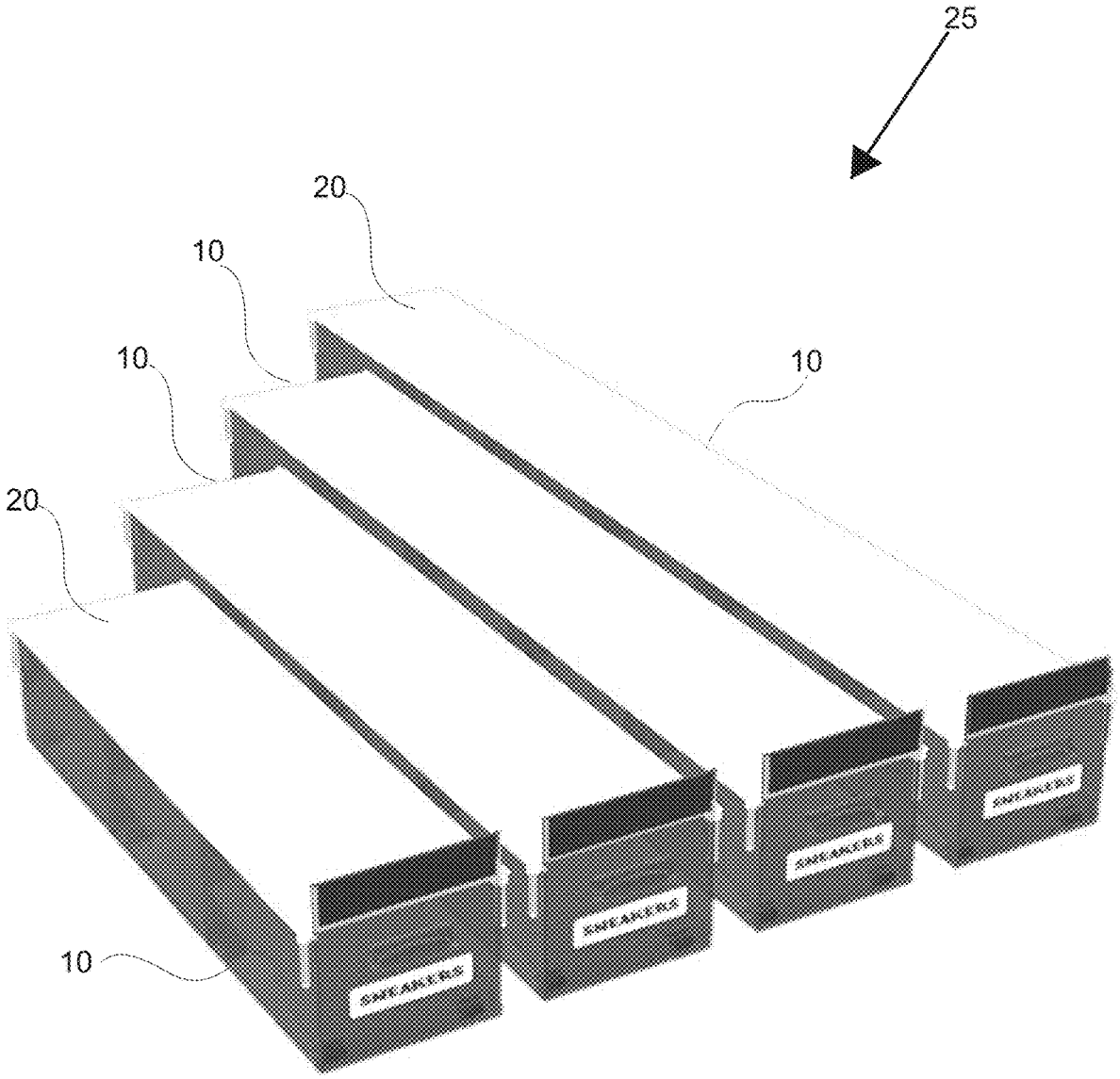
FIG. 6 shows a further embodiment of a storage system according to the present application.
Figure 7A:
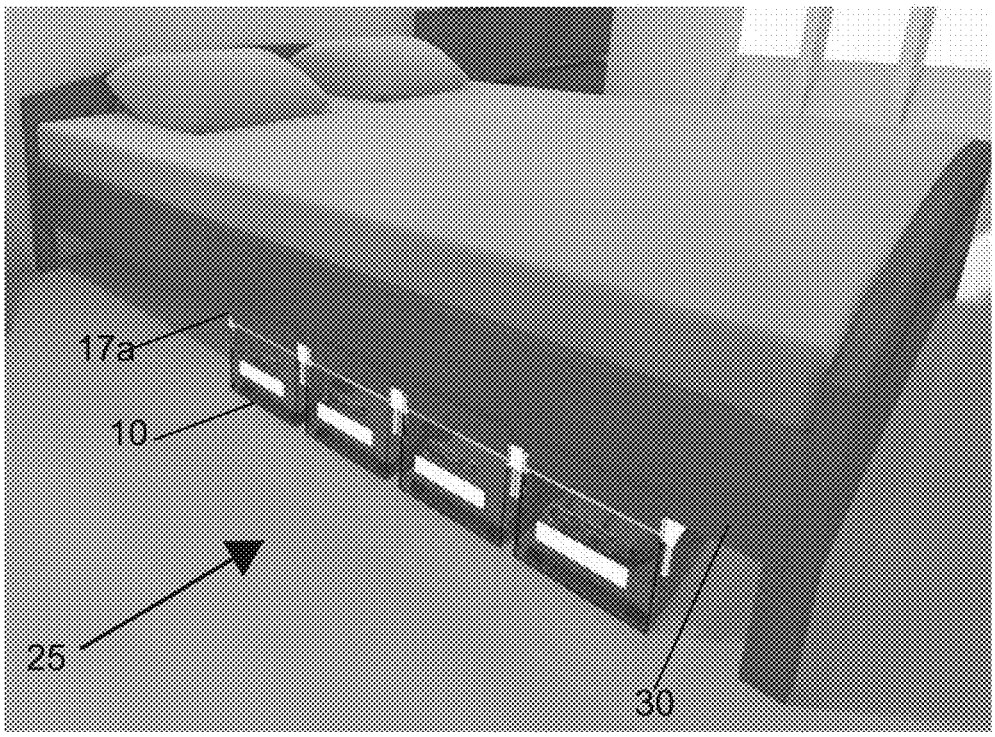
FIGS. 7A and 7B show a storage system according to the present application being stored under a bed.
Figure 7B:
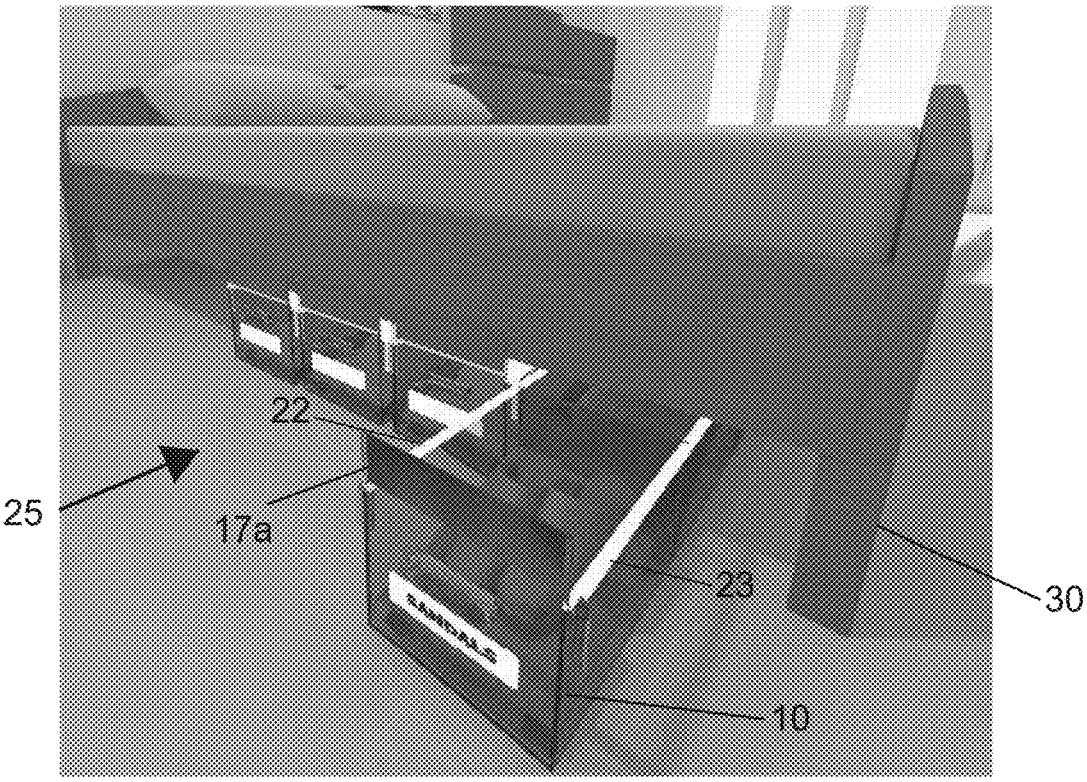

As shown in FIGS. 5A-7B, multiple storage apparatuses 10 may be connected to each other via their respective longitudinal hooks 22, 23 to form a storage system 25 that can be stored underneath a bed 30. A storage system 25 may comprise any number of storage apparatuses 10, and the size of the storage apparatuses 10 within a storage system 25 may be uniform (FIG. 5A) or can be different (FIG. 6). As described above, each storage apparatus 10 in the storage system 25 has the same orientation of longitudinal hooks 22, 23, such that the adjacent longitudinal sides of two adjacent storage apparatuses can engage each other through their respective longitudinal hooks 22, 23.

In additional embodiments of the storage system 25 and storage apparatus 10, wheel stoppers can be provided to prevent the wheels 14 from being pushed too far. The wheel stoppers can be, for example, an embedded lock in the wheels or grooved cups for slippery floors, to keep entirety of unit in place. The wheel stoppers can be applied to the anchors (the front and rear storage compartments 11*a*, 11*b*).

While there have been shown and described and pointed out fundamental novel features of the storage system as applied to embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. An apparatus comprising:

a plurality of adjoining storage compartments, including:

a front storage compartment arranged at a front end of the apparatus;

a rear storage compartment arranged at a rear end of the apparatus; and one or more intermediate storage compartments arranged in between the front storage compartment and the rear storage compartment;

wherein each of the front storage compartment, the rear storage compartment, and the one or more intermediate storage compartments comprises a removable insert forming an angled bottom surface configured to store one or more items at an angle;

a plurality of wheels arranged on a base of one or more of the plurality of adjoining storage compartments;

a removable cover configured to cover an open surface on a top of the plurality of adjoining storage compartments;

a first hook-like element spanning the plurality of adjoining storage compartments along a first longitudinal side of the apparatus between the front end and the rear end, the first hook-like element having a first orientation;

a second hook-like element spanning the plurality of adjoining storage compartments along a second longitudinal side of the apparatus between the front end and the rear end, the second hook-like element having a second orientation that is opposite the first orientation; and an outer face on the front storage compartment comprising a handle.

2. The apparatus according to claim 1, wherein the base of each of the plurality of adjoining storage compartments comprises at least two opposing wheels.

3. The apparatus according to claim 1, wherein the one or more intermediate storage compartments consists of one intermediate storage compartment and the plurality of adjoining storage compartments consists of three adjoining storage compartments.

4. The apparatus according to claim 1, wherein the one or more intermediate storage compartments consists of two intermediate storage compartments and the plurality of adjoining storage compartments consists of four adjoining storage compartments.

5. The apparatus according to claim 1, wherein the one or more intermediate storage compartments consists of three intermediate storage compartments and the plurality of adjoining storage compartments consists of five adjoining storage compartments.

6. The apparatus according to claim 1, wherein the one or more intermediate storage compartments consists of four intermediate storage compartments and the plurality of adjoining storage compartments consists of six adjoining storage compartments.

7. The apparatus according to claim 1, wherein the removable insert comprises:

a frictional surface configured to engage items placed thereon; and a handle configured to allow removal of the removable insert.

8. The apparatus according to claim 1, wherein the outer face comprises:

an upper lip extending above a height of the one or more intermediate storage compartments and the rear storage compartment and comprising a bumper pad on a reverse side of the outer face; and a placard.

9. The apparatus according to claim 1, wherein the first hook-like element and the second hook-like element are C-shaped hooks.

10. The apparatus according to claim 1, wherein:

the front storage compartment comprises a first pair of holes on opposite longitudinal sides;

the rear storage compartment comprises a second pair of holes on opposite longitudinal sides;

the removable cover comprises four pegs configured to engage each hole of the first pair of holes and the second pair of holes to secure the removable cover to the plurality of adjoining storage compartments; and the removable cover is formed of a cloth or fabric material.

11. The apparatus according to claim 1, wherein the plurality of adjoining storage compartments are made of a semi-transparent or transparent plastic material to enable a user to view contents of the plurality of adjoining storage compartments.

12. The apparatus according to claim 1, wherein each of the plurality of adjoining storage compartments comprises a length between eleven and fourteen inches.

13. The apparatus according to claim 1, further comprising a plurality of divider walls, wherein each of the divider walls separates two adjoining storage compartments and can move longitudinally through the apparatus to adjust a length of a storage compartment.

14. A storage system comprising:

a plurality of adjacent storage apparatuses, each storage apparatus comprising:

a plurality of adjoining storage compartments, including:

a front storage compartment arranged at a front end of the storage apparatus;

a rear storage compartment arranged at a rear end of the apparatus; and one or more intermediate storage compartments arranged in between the front storage compartment and the rear storage compartment;

wherein each of the front storage compartment, the rear storage compartment, and the one or more intermediate storage compartments comprises a removable insert forming an angled bottom surface configured to store one or more items at an angle;

a plurality of wheels arranged on a base of one or more of the plurality of adjoining storage compartments;

a removable cover configured to cover an open surface on a top of the plurality of adjoining storage compartments;

a first hook-like element spanning the plurality of adjoining storage compartments along a first longitudinal side of the storage apparatus between the front end and the second end, the first hook-like element having a first orientation;

a second hook-like element spanning the plurality of adjoining storage compartments along a second longitudinal side of the storage apparatus between the front end and the rear end, the second hook-like element having a second orientation that is opposite the first orientation; and an outer face on the front storage compartment comprising a handle;

wherein the first hook-like element of one of the plurality of storage apparatuses is configured to engage the second hook-like element of an adjacent of the plurality of storage apparatuses to provide a connection between two of the plurality of storage apparatuses to each other, said connection being provided iteratively across the plurality of storage apparatuses connecting adjacent storage apparatuses; and wherein for each adjacent pair of storage apparatuses, the first hook-like element of one storage apparatus of the pair is configured to slide through the second hook-like element of the adjacent storage apparatus in the pair to enable sliding on the plurality of wheels of one storage apparatus in the pair relative to the adjacent storage apparatus.

15. The storage system according to claim 14, wherein the storage system comprises four adjacent storage apparatuses.

16. The storage system according to claim 14, wherein the plurality of storage apparatuses comprises at least one storage apparatus having a length and a number of adjoining storage compartments that differs from at least one other storage apparatus in the storage system.

17. The storage system according to claim 14, wherein the first hook-like element and the second hook-like element are C-shaped hooks.

18. The storage system according to claim 14, wherein for each storage apparatus:

the front storage compartment comprises a first pair of holes on opposite longitudinal sides;

the rear storage compartment comprises a second pair of holes on opposite longitudinal sides;

the removable cover comprises four pegs configured to engage each hole of the first pair of holes and the second pair of holes to secure the removable cover to the plurality of adjoining storage compartments; and the removable cover is formed of a cloth or fabric material.

19. The storage system according to claim 14, wherein each of the plurality of adjoining storage compartments of the plurality of storage apparatuses comprises a length between eleven and fourteen inches.

20. The storage system according to claim 14, wherein each of the plurality of storage apparatuses further comprise a plurality of divider walls, wherein each of the divider walls separates two adjoining storage compartments and can move longitudinally through the apparatus to adjust a length of a storage compartment.

* * * * *